United States Patent [19]

Scholler

[11] Patent Number: 4,660,335

[45] Date of Patent: Apr. 28, 1987

[54] SPIRAL STAIRCASE ARRANGEMENT

[76] Inventor: Siegfried Scholler, 1726-5th Avenue North, Regina, Saskatchewan, Canada, S4R 0R5

[21] Appl. No.: 829,918

[22] Filed: Feb. 18, 1986

[30] Foreign Application Priority Data

Feb. 28, 1985 [GB] United Kingdom ..... 8505179

[51] Int. Cl.[4] ..... E04F 11/10; E04F 11/18

[52] U.S. Cl. ..... 52/187

[58] Field of Search ..... 52/187

[56] References Cited

U.S. PATENT DOCUMENTS

| | | | |
|---|---|---|---|
| 1,726,133 | 8/1929 | Wilson | 52/187 |
| 3,585,769 | 6/1971 | Guiseppe | 52/187 |
| 3,667,176 | 6/1972 | MacKay | 52/187 |
| 4,338,751 | 7/1982 | Sanders | 52/187 |

FOREIGN PATENT DOCUMENTS

| | | | |
|---|---|---|---|
| 2334671 | 1/1975 | Fed. Rep. of Germany | 52/187 |
| 2501892 | 7/1975 | Fed. Rep. of Germany | 52/187 |
| 2739365 | 3/1978 | Fed. Rep. of Germany | 52/187 |
| 2255445 | 7/1975 | France | 52/187 |
| 573528 | 3/1976 | Switzerland | 52/187 |

*Primary Examiner*—Alfred C. Perham

*Attorney, Agent, or Firm*—Adrian D. Battison; Stanley G. Ade

[57] ABSTRACT

A round or spiral staircase is formed from post pieces and treads with the treads each having a collar portion which cooperates with the post pieces to form a complete post. The collars are rotatable relative to the post portions to allow the treads to be aligned for transportation. The post portions and collars are clamped together by a longitudinal screw with end caps closing the end post portions. The upper end cap has an opening therein so that a pourable settable liquid reinforced with glass-fiber can be poured down the hole post with the treads arranged spirally to integrate the collars and post portions into a complete rigid post.

11 Claims, 4 Drawing Figures

SPIRAL STAIRCASE ARRANGEMENT

BACKGROUND OF THE INVENTION

This invention relates to a spiral staircase arrangement and particularly one which is manufactured in modular form and thus can be shipped in prefabricated pieces and assembled on site.

Conventionally spiral or around staircases are custom built by skilled carpenters in view of the great difficulty in shipping a completed structure of a large and complex nature.

It is one object of the present invention to provide an improved structure of round staircase arrangement which enables it to be manufactured in prefabricated form for simple assembly on site or for shipping in a partially assembled form, and yet to form a rigid stable structure when assembled.

SUMMARY OF THE INVENTION

According to the invention, therefore, there is provided a spiral staircase comprising a central post formed from a plurality of coaxial, hollow, axially separated post portions, a plurality of treads for supporting by said post in spiral arrangement around the post, said post positions and treads being arranged for rotation of said treads around the post from a position in which all the treads are aligned to a position in which they are separated angularly to form the round staircase, and means for integrating the post portions into an integral post supporting said treads, said integrating means including a hollow continuous channel extending longitudinally of said central post through each of said post portions and means arranged to receive a pourable, settable liquid material into and through said channel.

Preferably each tread includes a collar portion which engages adjacent ends of post portions which extend between each tread and the next adjacent tread. In this preferred arrangement, the collars of the treads can rotate relative to the post portions so that the treads can all be aligned to one angular position of the post for simple transportation as an assembled unit.

Preferably the post portions and treads are all clamped together by an elongate clamping screw which extends from a top cap down through the post to a bottom cap so that after twisting to the desired orientation, the screw can be tightened to clamp the integral post formed by the collars and post portions into a solid object.

The solidity of the post can be enhanced and completed by pouring a settable liquid down a hollow central core defined within hollow post portions and within the collar of each tread. Thus the post is effectively formed by a central set, preferably fibreglass reinforced, core with the post portions and treads surrounding the central core and held substantially immovable thereby.

In one arrangement the tread and collar is formed integrally from a laminate wood material with the collar defining a central recess for the poured settable material and an indentation in the upper and lowwer faces of the tread for receiving abutting edges of the post portions. In this case the post portions can simply be formed by cylindrical members for example cut from pipe.

In an alternative arrangement the treat and collars are formed separately from wood and are coupled together with each of the post portions including projecting flanges for engaging into an end of the collar. In this case the whole staircase can be formed from wood so that the central post effectively appears as a solid wooden object after clamping into the integral form.

The arrangement of the present invention, therefore, can provide a number of advantages. Firstly, the price can be considerably reduced in view of the prefabricated nature of the assembly. Secondly the product can be assembled on a "do it yourself" basis thus even further reducing labour costs involved. The price is also further reduced by the reduced shipping costs in view of the modular structure. The structure can provide a rigid staircase without the necessity for support boards at right angles to the plane of the tread.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 3:
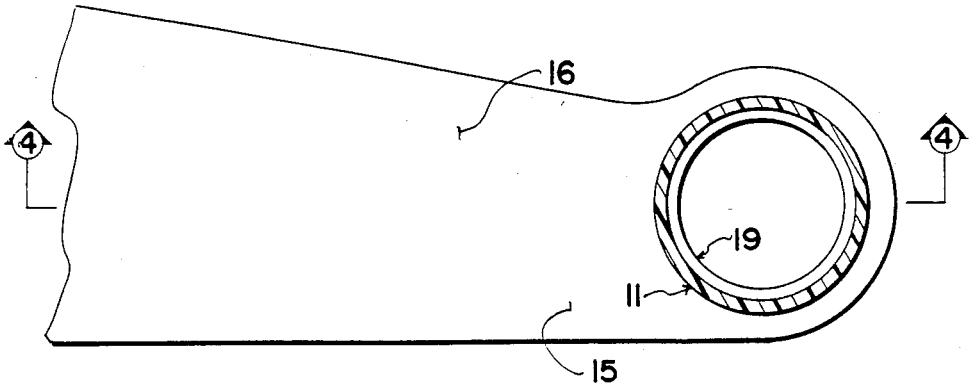
FIG. 3 is a cross sectional view of a second embodiment according to the invention taken along the lines 3—3 of FIG. 4.
Figure 4:
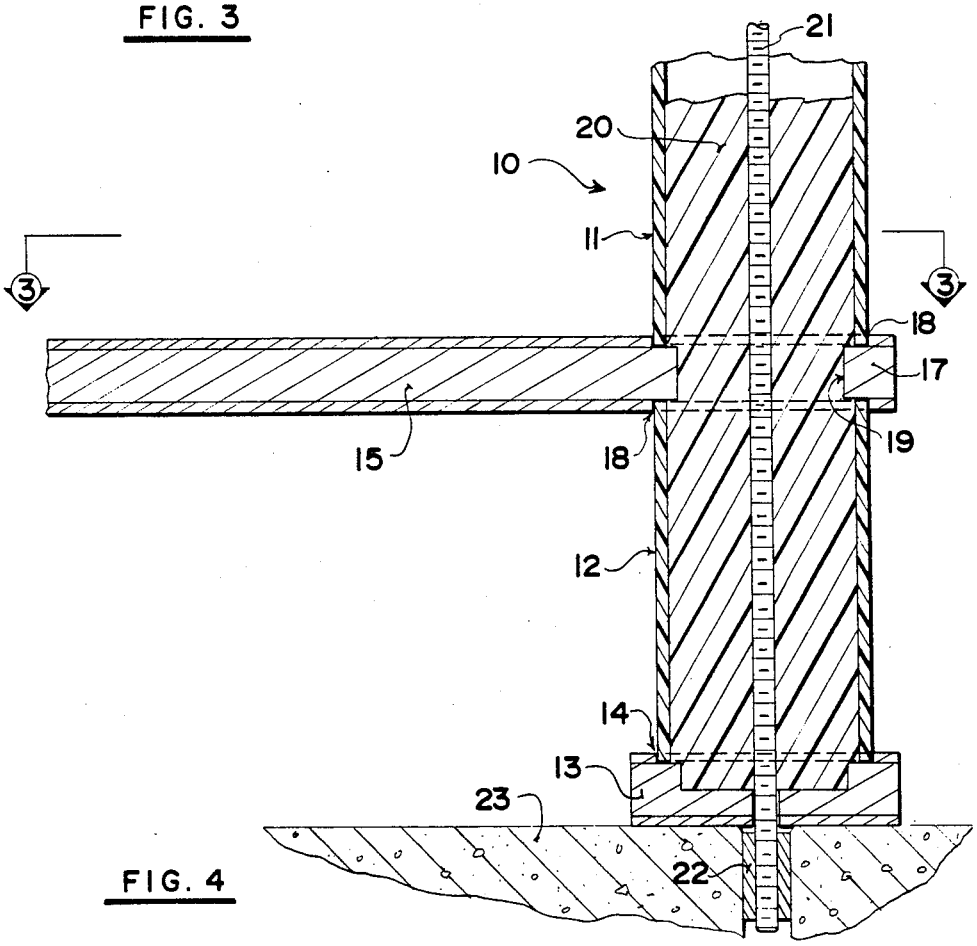
FIG. 4 is a cross sectional view of the embodiment of FIG. 3 taken along the lines 4—4 of FIG. 3.

Referring firstly to FIGS. 3 and 4, a spiral staircase comprises a central post generally indicated at 10 formed from a plurality of post portions. In this case only a single tread is illustrated together with the adjacent post portions. It will be appreciated that a complete spiral staircase is formed from a complete central post and a plurality of treads each of which is formed as shown in FIGS. 3 and 4.

Thus the central post 10 comprises a plurality of post portions 11, 12 each of which comprises a simple cylindrical member which may be cut from a suitable pipe for example 4-inch ABS plastics pipe. An end cap is indicated at 13 at a lower end of the post and it will be appreciated that a similar end cap is provided at the upper end but is not shown for convenience of illustration. The end cap is formed as a disc of a laminate wood material with a counter bore 14 into which an end portion of the post portion 12 is inserted as a press fit.

Each tread generally indicated at 15 comprises a tread portion 16 on which the feed of the user normally will stand and a collar portion 17 for surrounding the post and particularly the post portion 11 as illustrated. The collar portion 17 is generally circular in shape and integral with the step portion 16. A recess in the upper and lower surfaces of the collar portion is indicated at 18 and can simply be formed by cutting away an outer laminate sheet of the tread 15 in a circular form so as to provide a recess for receiving an end of the abutting post portion. A central bore 19 within the collar portion provides a continuous substantially cylindrical channel through the post portions and through the treads for receiving a settable liquid for example glass-fiber reinforced resin indicated at 20.

The whole post provided by the collar portion 17 and the post portions 11 and 12 together of course with the portions not shown in FIGS. 3 and 4 can initially be clamped together by a screw threaded rod 21 carrying a lower nut 22 at the end cap 13 and an upper nut (not shown) at the upper end cap. Thus by tightening the nuts 22 on the rod 21, the end caps can be drawn together so as to clamp the post into an integral unit prior to pouring of the settable resin material 20.

The post can be coupled to the floor 23 by the rod 21 and similarly can be coupled at the upper end to the floor of the next level by the upper end of the rod 21.

For convenience of illustration, the handrail, ballusters and spacers at the outer edge of the treads are omitted from FIGS. 3 and 4 but it will be appreciated that devices of a conventional nature could be incorporated.

Figure 1:
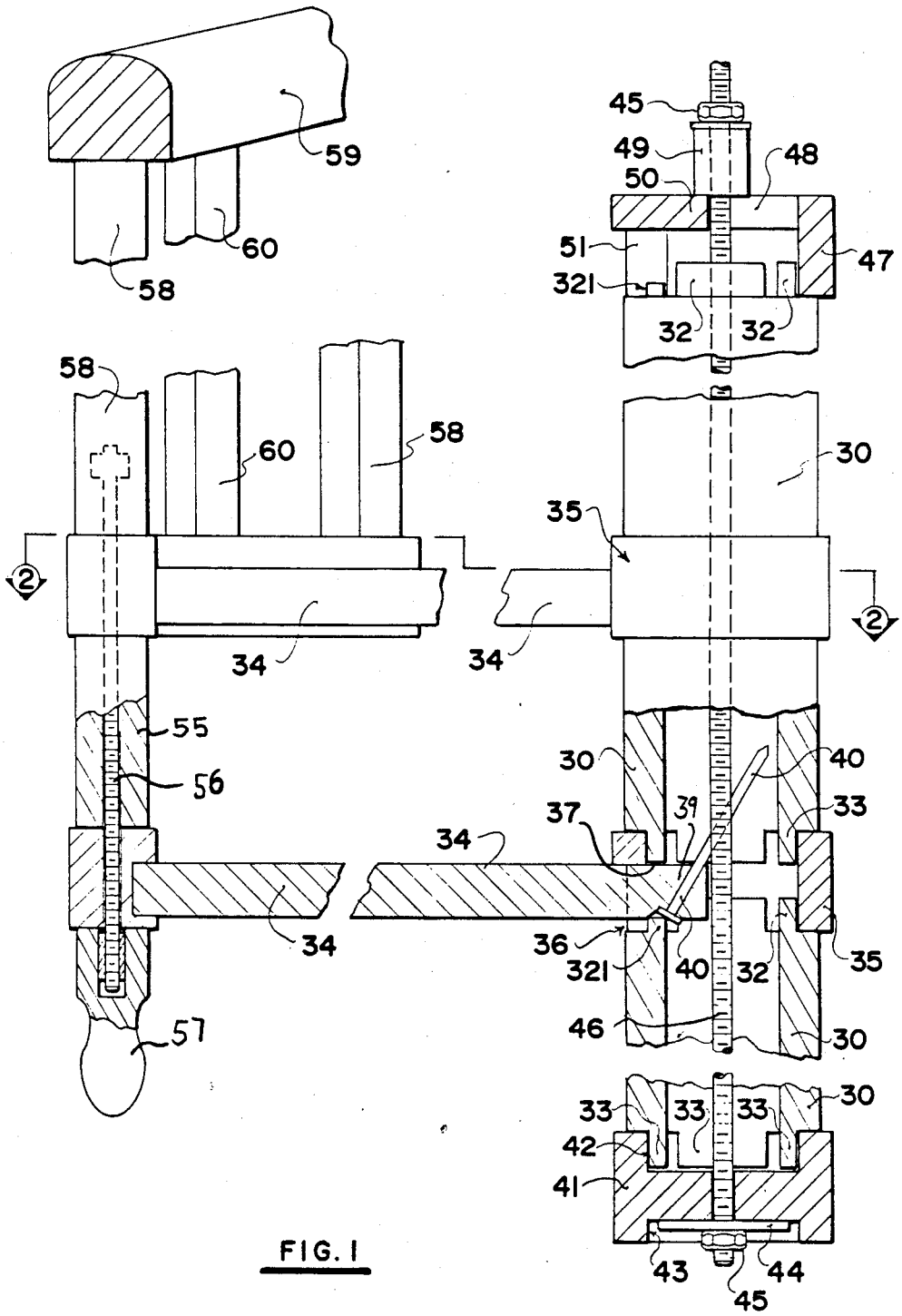
FIG. 1 is a cross sectional view of a portion of a spiral staircase assembly according to the invention, taken along the line 1—1 of FIG. 2.
Figure 2:
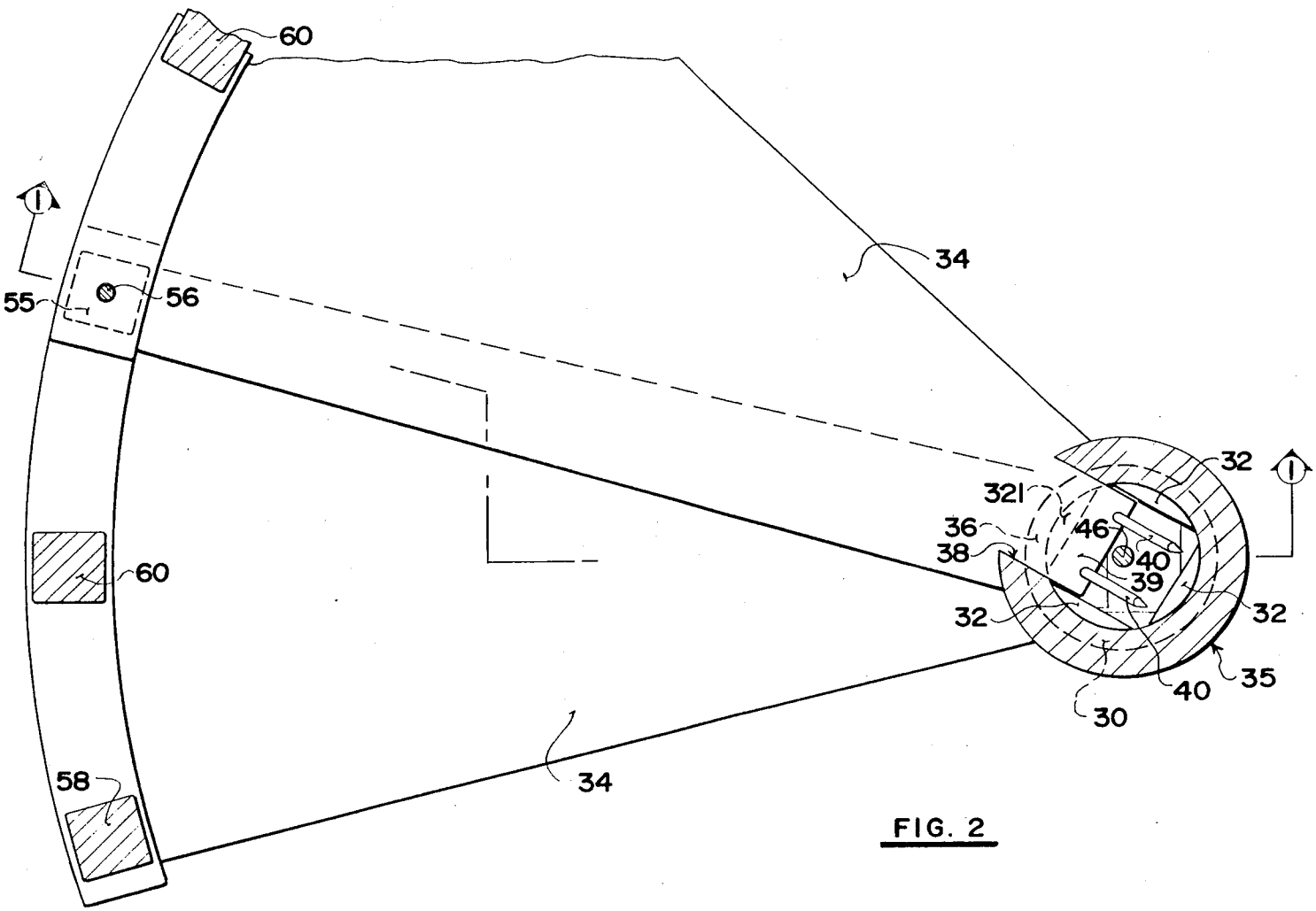
FIG. 2 is a cross sectional view along the lines 2—2 of FIG. 1.

Turning now to FIGS. 1 and 2, the structure shown is substantially as described in relation to FIGS. 3 and 4 but is of a better quality since the outer appearance of the post is effectively completely provided by a hardwood periphery.

Thus in FIGS. 1 and 2, the post portions are provided by cylindrical wood forms 30 each formed from four separate pieces glued together at parallel longitudinal planes. Each piece of the post portion includes an upstanding flange 32, 33 from the upper and lower ends respectively thereof. The manufacture of the post portion from four pieces as shown is most convenient and provides an outer cylindrical surface, a central square bore and the flanges as required.

Each tread 34 is formed from a laminate or plywood planar piece of substantially triangular shape leading to an apex at a central collar 35 coaxial with the post portions 30. Each collar is substantially cylindrical and has a cut-out 36 over part of the height thereof for receiving the inner apex of the respective tread 34. Thus the cut-out defines a surface 37 against which the upper surface of the tread 34 engages. To provide a particularly interlocking nature between the collar and the tread, the tread is cut down in width at 38 so that a tongue 39 thereof is left exposed to project into the cut-out 36. The collar and tread are then coupled by glue so as to provide a temporary interconnection prior to receipt of the settable liquid as described previously. In order to embed the tread 34 rigidly in the resin, a pair of spikes 40 is inserted through the tongue 39 so as to project into the interior of the hollow core of the next adjacent post portion.

It will be noted that the flange indicated at 321 at the tread is shortened so that it can rest against the under surface of the tread while the remaining flanges are longer to provide greater interconnection between the collar and post portion.

A lowermost collar 41 provides an upper circular recess 42 for receiving the lowermost flanges 33 of the lowermost post portion. In addition a lower recess 43 is provided in the bottom collar 41 for receiving a metal plate 44 mounted on a screw 46 carrying a lowermost nut 45.

An uppermost collar 47 includes a cylindrical recess for the upper flanges 32 of the uppermost post portion with a central bore for the screw 46 and an opening 48 through which the setting resin can be poured after clamping of the whole unit together by the screw and nuts 46, 45. At the upper collar, a wooden spacer block 49 is positioned which can be screwed to the upper collar 47 through an upper face 50 thereof. The upper collar includes a cut-out 51 similar to the cut-outs for the treads indicated at 36 for receiving a portion of the floor of the upper storey so as to locate the upper end of the post within the building.

The lower flanges 33 of each post portion are free to rotate within the cylindrical bore defined in the adjacent collar so that all the treads can be rotated angularly of the post axis so they can be aligned to one side of the post for transportation. In order to achieve this, the clamping force from the screw 46 can be reduced and then reapplied to hold the structure integral during transportation.

At a site where the unit is to be assembled, the screw force can again be reduced and the treads rotated to their proper angular position to provide the spiral staircase around the post following which the screw force can again be applied to clamp the treads in the required position.

Each tread has an opening at a front edge and an opening at a rear edge so that it can be angularly spaced from its next adjacent tread by a spacer member 55 which has a hollow bore for receiving a screw 56 which passes through the spacer 55 and through the opening at a front edge of one of the threads and the opening at a rear edge of the adjacent tread. The lower end of the screw 56 is attached to a finishing acorn 57 and the upper end is attached to a balluster 58 which extends from the upper tread a height sufficient to support a hand rail 59 at the upper end thereof. Thus the handrail 59 is of a conventional spiral form and can be formed in three pieces and attached simply as a press fit with glue onto each of the ballusters 58 coupled to the screws 56. Intervening ballusters 60 can also be provided if required to provide a pleasing appearance and any required safety. These ballusters can be attached by carriage bolts through the respective tread and a glued press fit into the handrail 59.

After assembly of the post portions, treads, ballusters and handrail, the integral structure can then be completed in its rigidity by the pouring of the settable resin material through the opening 48. This material is coupled integrally to each of the treads by the spikes 40 and to each of the post portions in view of the square cross section thereof. The whole post, therefore, is competed as an integral unit held together both by the clamping effect of the screw and the supporting effect of the reinforced resin material.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A spiral staircase subassembly for erection into a spiral staircase comprising in assembled combination, a central post formed from a plurality of coiaxial, hollow, axially separated post portions, a plurality of treads supported on said post in axially aligned position, each tread being formed from wood and comprising a tread portion extending to one side of the post and a collar portion coaxial with and arranged end to end with a respective pair of adjacent post portions, each said collar portion and associated tread portion being arranged for free rotation of said collar portion relative to an adjacent post portion about the axis of the post so as to allow the treads to rotate from said axially aligned position to a position in which they are separated angularly to form the spiral staircase, a pair of end cap members each mounted at a respective end of the post, a rod extending longitudinally of said post inside said post portions and said collar portions and engaged with said end cap members to hold said post portions and collar portions in coaxial end to end relation forming said post, each of said tread portions having a first opening adjacent a front edge and a second opening adjacent a rear edge whereby each tread portion can be accurately located in said angularly separated position relative to an adjacent tread portion by a member extending from the first opening of said each tread portion to the second opening of said adjacent tread portion, and means for integrating the post portions and collar portions into an integral post supporting said treads, said integrating means including a hollow continuous channel extending longitudinally of said central post through each of said post portions and collar portions and opening means in an uppermost one of said end cap members arranged to receive a pourable, settable liquid material into and through said channel.

2. The invention according to claim 1 wherein said collar portions and said post portions include axially extending interlocking projection means to provide interconnection between each of said collar means and a respective adjacent one of said post portions.

3. The invention according to claim 1 wherein each of said tread portions includes spike means extending therefrom into said channel whereby to engage with said settable liquid.

4. The invention according to claim 1 wherein said tread portion is formed separately from said collar portion.

5. The invention according to claim 4 wherein said tread portion includes a tongue for projecting radially into said collar portion.

6. The invention according to claim 5 wherein said collar portion includes a slot extending from one axial end of said collar portion for receiving said tongue.

7. The invention according to claim 4 wherein each of said post portions includes axially projecting flange means spaced inwardly from an outer face of said post portion for projecting into and cooperating with a respective one of said collar portions.

8. The invention according to claim 7 wherein said axially projecting flange means are arranged to project into engagement with one face of said tread portion.

9. The invention according to claim 1 wherein said collar portion and tread portion are cut from an integral tread piece so as to define an opening through said tread for receiving said settable liquid material.

10. The invention according to claim 9 wherein said tread piece is formed from a laminate material, upper and lower layers of which are removed at said post portion to receive an axially extending face of said post portion.

11. The invention according to claim 10 wherein the post portions are formed from tubular plastics material.

* * * * *